US006160392A

United States Patent [19]

Shin

[11] Patent Number: 6,160,392

[45] Date of Patent: Dec. 12, 2000

[54] START-UP CIRCUIT FOR VOLTAGE REFERENCE GENERATOR

[75] Inventor: Youn-Cherl Shin, Bucheon, Rep. of Korea

[73] Assignee: LG Semicon Co., Ltd., Choongcheongbuk-Do, Rep. of Korea

[21] Appl. No.: 09/225,304

[22] Filed: Jan. 5, 1999

[30] Foreign Application Priority Data

Jun. 5, 1998 [KR] Rep. of Korea ..... 98-20885

[51] Int. Cl.[7] ..... G05F 3/16

[52] U.S. Cl. ..... 323/313; 323/284; 323/901

[58] Field of Search ..... 323/284, 901, 323/313

[56] References Cited

U.S. PATENT DOCUMENTS 4,311,954 1/1982 Capel ..... 323/284
5,034,626 7/1991 Pirez et al. ..... 323/315
5,367,249 11/1994 Honnigford ..... 323/313
5,686,825 11/1997 Suh et al. ..... 323/316
5,883,501 3/1999 Arakawa ..... 323/284

*Primary Examiner*—Peter S. Wong
*Assistant Examiner*—Gary L Laxton
*Attorney, Agent, or Firm*—Morgan, Lewis & Bockius LLP

[57] ABSTRACT

A start-up circuit for a reference voltage generator which restarts a reference voltage generating circuit when a reference voltage drops below a predetermined level due to noises or change of a power supply voltage. The start-up circuit according to the present invention includes a reference voltage generating unit operated by an input signal and generating a reference voltage in accordance with a power supply voltage, a reference voltage sensing unit determining whether an output signal from the reference voltage generating unit is lower than a predetermined voltage level, and a start-up circuit unit determining an initial operation of the reference voltage generating unit in accordance with a reset signal and supplying the input signal to restart the reference voltage generating unit in accordance with an output signal from the reference voltage sensing unit.

8 Claims, 2 Drawing Sheets

START-UP CIRCUIT FOR VOLTAGE REFERENCE GENERATOR

BACKGROUND OF THE INVENTION

1. Field of the Invention

The present invention relates to a voltage reference generator, and more particularly to a start-up circuit for a reference voltage circuit that restarts the reference voltage circuit when a reference voltage drops under a predetermined level due to noises or change of a supply voltage.

2. Description of the Conventional Art

FIG. 1 is a schematic circuit diagram of a conventional reference voltage generator.

As shown therein, the conventional reference voltage generator is composed of a start-up circuit unit 10 enabled by a reset signal RESET in power up and operating a following reference voltage generating unit 20 and the reference voltage generating unit 20 operated by a signal outputted from the start-up circuit unit 10 and generating a reference voltage in accordance with a power supply voltage Vcc.

The start-up circuit unit 10 includes a first NMOS transistor 11 having a gate for receiving the reset signal RESET and a drain connected with the reference voltage generating unit 20, and a second NMOS transistor 12 having a drain connected with a source of the first NMOS transistor 11, a gate commonly connected with the drain thereof and a source connected with a ground voltage Vss.

The reference voltage generating unit 20 includes a first and a second PMOS transistors 21, 22 constituting a current mirror and each source is connected with the power supply voltage Vcc, a first and a second NMOS transistors 23, 24 connected with the first and the second PMOS transistors 21, 22, respectively, and constituting a current mirror, and a resistor 25 connected between the first NMOS transistor 23 and the ground voltage Vss. Now, the operation of the conventional reference voltage generator will be described.

First, when power is externally applied, power supply circuits in a chip device operate and thus power-up is carried out.

The transistors 21, 22, 23, 24 of the reference voltage generating unit 20 are initially in an off state, and a voltage of a node N20 of the first PMOS transistor 21 is determined higher than a voltage difference (Vcc-|Vtp|) between the power supply voltage Vcc and a threshold voltage Vtp of the PMOS transistor 21.

While the power-up is carried out, the reset signal RESET is applied to the gate of the first NMOS transistor 11 of the start-up circuit unit 10 at a high level for a certain period, that is a predetermined initial period for which a system voltage increases from the ground voltage Vss to the power supply voltage Vcc.

Accordingly, the first NMOS transistor 11 is turned on and a potential of the node N20 connected with the reference voltage generating unit 20 is pulled down. Thus, the first and the second PMOS transistors 21, 22 are turned on and a reference voltage Vref is generated.

However, in the conventional voltage generator when the power supply voltage Vcc becomes instantaneously unstable due to conditions such as external noises, the reference voltage Vref can not be a sufficient voltage level. In this case, it is impossible for the conventional start-up circuit unit 10 to restart the reference voltage generating unit 20.

SUMMARY OF THE INVENTION

Accordingly, the present invention is directed to a start-up circuit for a reference voltage generator that restarts a reference voltage generator when a reference voltage drops under a predetermined level due to noises or change of a supply voltage, thus supplying a normal reference voltage.

To achieve these and other advantages and in accordance with the purpose of the present invention, as embodied and broadly described, a start-up circuit for a reference voltage generator includes a reference voltage generating unit operated by an input signal and generating a reference voltage in accordance with a power supply voltage, a reference voltage sensing unit sensing that an output signal from the reference voltage generating unit is lower than a predetermined voltage level, and a start-up circuit unit determining an initial operation of the reference voltage generating unit in accordance with a reset signal and outputting the input signal to restart the reference voltage generating unit in accordance with an output signal from the reference voltage sensing unit.

It is to be understood that both the foregoing general description and the following detailed description are exemplary and explanatory and are intended to provide and further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiment of the present invention, an example of which is illustrated in the accompanying drawing.

Figure 1:
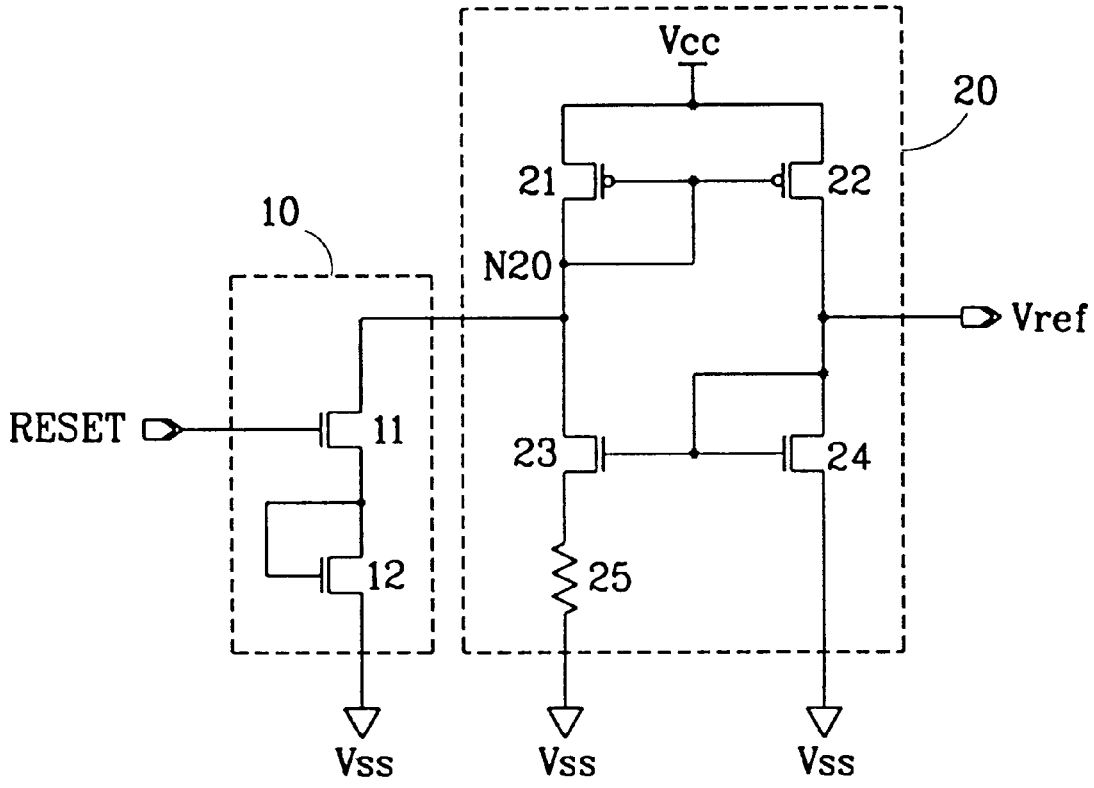
FIG. 1 PRIOR ART
FIG. 1 is a schematic circuit diagram of a conventional start-up circuit for a reference voltage generator.
Figure 2:
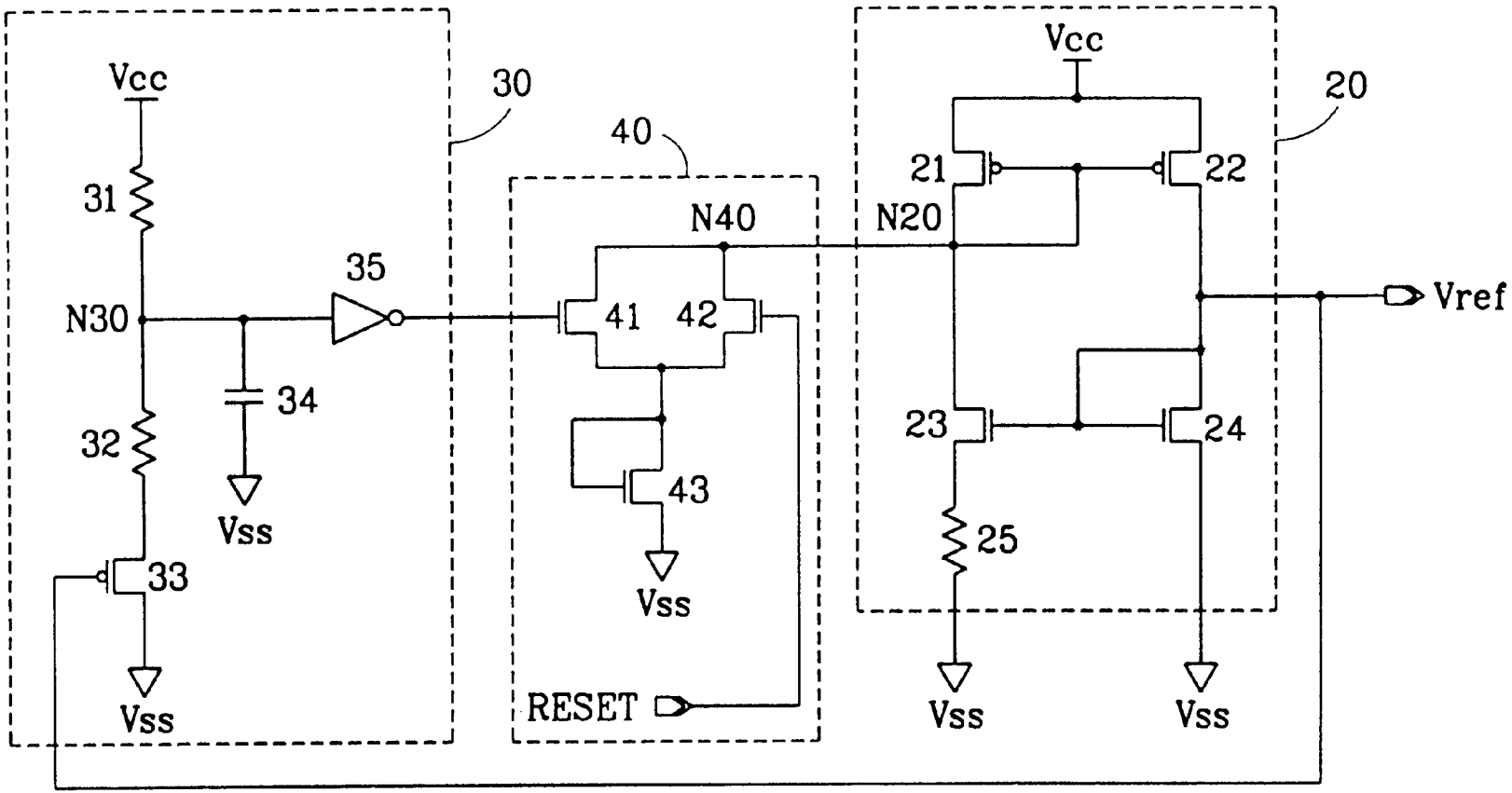
FIG. 2 is a schematic circuit diagram of a start-up circuit for a reference voltage generator according to the present invention.

FIG. 2 is a schematic circuit diagram of a start-up circuit for a reference voltage generator according to the present invention.

As shown therein, the start-up circuit for the reference voltage generator according to the present invention is composed of a reference voltage generating unit 20 operated by an input signal and generating a reference voltage signal Vref in accordance with a power supply voltage Vcc, a reference voltage sensing unit 30 determining whether the reference voltage signal Vref outputted from the reference voltage generating unit 20 is lower than a predetermined voltage value, and a start-up circuit unit 40 determining an initial operation of the reference voltage generating unit 20 in accordance with a reset signal RESET and supplying the input signal to restart the reference voltage generating unit 20 in accordance with a signal outputted from the reference voltage sensing unit 30.

The reference voltage generating unit 20, as described in the conventional art, includes a first and a second PMOS transistors 21, 22 constituting a current mirror and each source is connected with the power supply voltage Vcc, a first and a second NMOS transistors 23, 24 constituting a current mirror and connected with the first and the second PMOS transistors 21, 22, respectively, and a resistor 25 connected between the first NMOS transistor 23 and ground.

The reference voltage sensing unit 30 is composed of a first resistor 31 and a second resistors 32 which are connected with the power supply voltage Vcc in series, a PMOS transistor 33 connected between the second resistor 32 and the ground voltage Vss and having a gate for receiving the reference voltage signal Vref outputted from the reference voltage generating unit 20, a capacitor 34 connected with a node N30 provided between the first and the second resistors 31, 32, and an inverter 35 inverting a signal outputted from the node N30 and supplying a resultant signal to the start-up circuit unit 40.

The start-up circuit unit 40 is composed of a first NMOS transistor 42 having a gate for receiving the reset signal RESET and determining an initial operation of the reference voltage generating unit 20 in accordance with the reset signal RESET, a second NMOS transistor 41 having a gate for receiving an output signal from the reference voltage sensing unit 30 and connected with the first NMOS transistor 42 in parallel, and a third NMOS transistor 43 connected between sources of the first and the second NMOS transistors 42, 41 and the ground.

Now, the operation of the thusly constructed start-up circuit for the reference voltage generator according to the present invention will be described.

First, if a potential of the node N20 connected with the reference voltage generating unit 20 drops below a predetermined level, the first and second PMOS transistors 21, 22 of the reference voltage generating unit 20 are turned on, thus the reference voltage Vref is generated.

The reference voltage Vref is applied to the gate of the PMOS transistor 33 of the reference voltage sensing unit 30 and thus the PMOS transistor 33 is determined whether to be operated or not in accordance with the reference voltage Vref. That is, when the reference voltage value maintains a normal level, namely when the reference voltage is higher than a threshold voltage Vtp of the PMOS transistor 33, the PMOS transistor 33 does not operate, whereas if the reference voltage Vref is lower than the threshold voltage Vtp of the PMOS transistor 33, the PMOS transistor 33 is turned on.

Here, the first and second resistors 31, 32 restrain a current which flows to the ground when the PMOS transistor 33 is turned on and adequately controls a resistance ratio of the two resistors 31, 32, thereby pulling down a potential of the node N30 located between the resistors 31, 32 below a logic threshold voltage level of the inverter 35. Thus, the potential of the node N30 is pulled down to a low level and then inverted to a high level by the inverter 35. Here, the capacitor 34 serves as to prevent the inverter 35 from being erroneously operated by eliminating noises of the node N30.

The high-level signal outputted from the inverter 35 is applied to the gate of the second NMOS transistor 41 of the start-up circuit unit 40, thereby turning on the second NMOS transistor 41.

Accordingly, when the node N40 at the drain side of the second NMOS transistor 41 is pulled down and a potential of the node N20 of the reference signal generating unit 20 connected with the node N40 drops below the predetermined level, the first and second PMOS transistors 21, 22 of the reference voltage generating unit 20 are turned on and the reference voltage Vref is generated again.

As described above, when the reference voltage drops below the predetermined level due to the factors such as noises, the start-up circuit for the reference voltage generator according to the present invention senses the reference voltage value and restarts the reference voltage generating circuit thereof, thereby regenerating a reference voltage at a predetermined normal level.

It will be apparent to those skilled in the art that various modifications and variations can be made in the start-up circuit for the reference voltage generator of the present invention without departing from the spirit or scope of the invention. Thus, it is intended that the present invention cover the modifications and variations of this invention provided they come within the scope of the appended claims and their equivalents.

What is claimed is:

1. A reference voltage generator for a semiconductor device, comprising:

a reference voltage generating circuit for receiving an input signal and generating a reference voltage in accordance with a power supply voltage;

a reference voltage sensing circuit for determining whether the reference voltage from the reference voltage generating circuit is lower than a predetermined voltage level and generating an output signal; and a start-up circuit for determining an initial operation of the reference voltage generating circuit in accordance with a reset signal and generating the input signal to control the reference voltage generating circuit in accordance with the output signal from the reference voltage sensing circuit.

2. The reference voltage generator of claim 1, wherein the reference voltage generating circuit comprises:

a first current mirror connected to the power supply voltage and composed of a first and a second PMOS transistors;

a second current mirror connected with the first current mirror in series and composed of a first and a second NMOS transistors; and a resistor connected between the first NMOS transistor and ground, wherein the reference voltage generating circuit receives the input signal from the start up circuit at a first connection terminal connecting the first and second current mirrors and generates the reference voltage at a second connection terminal connecting the first and second current mirrors.

3. The reference voltage generator of claim 1, wherein the reference voltage sensing circuit comprises:

a first resistor and a second resistor which are connected with the power supply voltage in series;

a PMOS transistor connected between the second resistor and the ground, for receiving the reference voltage from the reference voltage generating unit and determining whether the reference voltage is below the predetermined voltage level; and an inverter connected to a connection terminal between the first resistor and the second resistor.

4. The reference voltage generator of claim 3, wherein, using a threshold voltage of the PMOS transistor, the PMOS transistor determines whether a level of the reference voltage from the reference voltage generating circuit is lower than the predetermined voltage level.

5. The reference voltage generator of claim 3, wherein when the reference voltage from the reference voltage generating circuit has a voltage level lower than the predetermined voltage level, a value of the output signal from the reference voltage sensing circuit is adjusted in accordance with a resistance ratio of the first and second resistors.

6. The reference voltage generator of claim 3, wherein the reference voltage sensing circuit further comprises:

a capacitor connected between the connection terminal between the first and second resistors and the ground in order to eliminate noises.

7. The reference voltage generator of claim 1, wherein the start-up circuit comprises:

a first NMOS transistor for determining the initial operation of the reference voltage generating circuit in accordance with the reset signal; and a second NMOS transistor for receiving the output signal from the reference voltage sensing circuit and determining a restart of the operation of the reference voltage generating circuit.

8. The reference voltage generator of claim 7, wherein the start-up circuit further comprises:

a third NMOS transistor connected between sources of the first and second NMOS transistors and the ground, gate and drain of the third NMOS transistor being connected together, wherein the reset signal is supplied to a gate of the first NMOS transistor and the output signal from the reference voltage sensing circuit is applied to a gate of the second NMOS transistor, drains of the first and second NMOS transistors are connected together to generate the input signal.

* * * * *